US006114047A

United States Patent [19]

Ohta

[11] Patent Number: 6,114,047

[45] Date of Patent: Sep. 5, 2000

[54] RECORDING MATERIAL

[75] Inventor: Tetsuzi Ohta, Mitaka, Japan

[73] Assignee: Kimoto Co., Ltd., Japan

[21] Appl. No.: 08/312,036

[22] Filed: Sep. 26, 1994

[30] Foreign Application Priority Data

Sep. 30, 1993 [JP] Japan ..... 5-244788

[51] Int. Cl.[7] ..... B41M 5/00

[52] U.S. Cl. ..... 428/522; 428/195; 428/480; 428/483; 428/500

[58] Field of Search ..... 428/195, 331, 428/500, 511, 537.5, 522, 480, 483

[56] References Cited

U.S. PATENT DOCUMENTS

| | | | |
|---|---|---|---|
| 4,446,174 | 5/1984 | Maekawa et al. | 428/331 |
| 4,857,386 | 8/1989 | Butters et al. | 428/206 |
| 4,944,988 | 7/1990 | Yasuda et al. | 428/195 |
| 5,126,193 | 6/1992 | Light | 428/327 |

FOREIGN PATENT DOCUMENTS

| | | |
|---|---|---|
| 233703 | 1/1987 | European Pat. Off. . |
| 6121780 | 9/1986 | Japan . |
| 62-218181 | 9/1987 | Japan . |
| 62-222884 | 9/1987 | Japan . |
| 63-173678 | 7/1988 | Japan . |
| 5177921 | 7/1993 | Japan . |

OTHER PUBLICATIONS

Derwent No. 86–123 149, Apr. 1986.
Derwent No. 92–196 097, Apr. 1992.
Derwent No 87–267 045, Aug. 1987.

*Primary Examiner*—Pamela R. Schwartz
*Attorney, Agent, or Firm*—Lorusso & Loud

[57] ABSTRACT

Recording material comprising a substrate and an ink-receiving layer(s) provided on at least one surface of the substrate, wherein the ink-receiving layer comprises polyvinylpyrrolidone and a basic (meth)acrylic acid ester copolymer prepared from at least four kinds of monomers, which can be used in common for ink-jet printing, direct thermal transfer printing, PPC and pen plotter printing.

8 Claims, 1 Drawing Sheet

RECORDING MATERIAL

BACKGROUND OF THE INVENTION

1. Field of the Invention

The present invention relates to recording material and, more particularly, it relates to recording material which may be used in common for various output printing machines widely used for business and home uses such as ink-jet printing machines, PPC machines and direct thermal transfer printing machines.

2. Prior Art

Hitherto, various kinds of recording paper have been developed depending on the kinds of printing machines such as direct thermal transfer printing machines, PPC machines, pen plotters and ink-jet printing machines. For example, for the use in ink-jet printing, though ordinary paper may be used for this printing method, there have been proposed various kinds of recording paper provided with ink-receiving layers which consist of porous layers or comprise water-soluble resins such as polyvinylpyrrolidone, polyvinyl alcohol and gelatin. Such recording paper for ink-jet printing must have good ink absorbency and water resistance and therefore there has been proposed recording paper of which ink receiving layer comprises a graft copolymer and/or a block copolymer so that it satisfies the both requirements of water absorbency and water resistance (Japanese Patent Un-examined Publication (KOKAI) No. 61-217280).

However, polymerization for preparing such a block co-polymer is a troublesome task and, moreover, the performance of resulting copolymers could not be completely sufficient.

There have been also proposed various kinds of recording paper other than the ones mentioned above in order to satisfy the requirements of water absorbency and water resistance, for example, those utilizing, as the resin contained in the ink-receiving layer, hydrophilic polyvinylpyrrolidone (hereinafter referred as "PVP") and an acidic component of (meth)acrylic polymers (Japanese Patent Un-examined Publication (KOKAI) No. 62-218181) or specific (meth)acrylic polymers (Japanese Patent Un-examined Publication (KOKAI) Nos. 62-222884 and 63-173678). However, those utilizing (meth)acrylic polymers alone have drawbacks, i.e., bad ink absorbency and extremely low ink drying rate. Moreover, acidic (meth)acrylic polymers show bad compatibility with PVP and therefore, when mixed with PVP, they present drawbacks that it is difficult to obtain uniform coatings and it is difficult to adjust physical properties of coatings.

When designing ink-receiving layers of recording materials for ink-jet printing, ink absorption and retention properties had been considered with respect only to aqueous inks. But, there have recently been proposed certain materials comprising hydrophilic and hydrophobic resins in ink-receiving layers, thereby these materials can be used for ink-jet printing and PPC (electrophotographic copiers) in common (Japanese Patent Un-examined Publication (KOKAI) No. 5-177921). The ink-receiving layers of these kinds of recording paper are made have toner adhesion in addition to absorbency with respect to aqueous inks and water resistance. However, any recording paper which may be more widely used, i.e., which may also be used for direct thermal transfer printing, pen plotter printing and the like has not been proposed yet.

SUMMARY OF THE INVENTION

The present invention has been completed in order to eliminate the drawbacks of prior art recording material described above and hence the object of the present invention is to provide recording material which has properties necessary for ink-jet printing and, in addition, may be used in common for PPC, direct thermal transfer printing, pen plotter and the like.

Accordingly, the present invention provides recording material, which can achieve the object described above, comprising a substrate and an ink-receiving layer(s) provided on at least one surface of the substrate, wherein the ink-receiving layer utilizes polyvinylpyrrolidone as a hydrophilic resin and a basic (meth)acrylic acid ester copolymer prepared from at least four kinds of monomers as a lipophilic resin.

DESCRIPTION OF THE PREFERRED EMBODIMENTS

Figure 1:
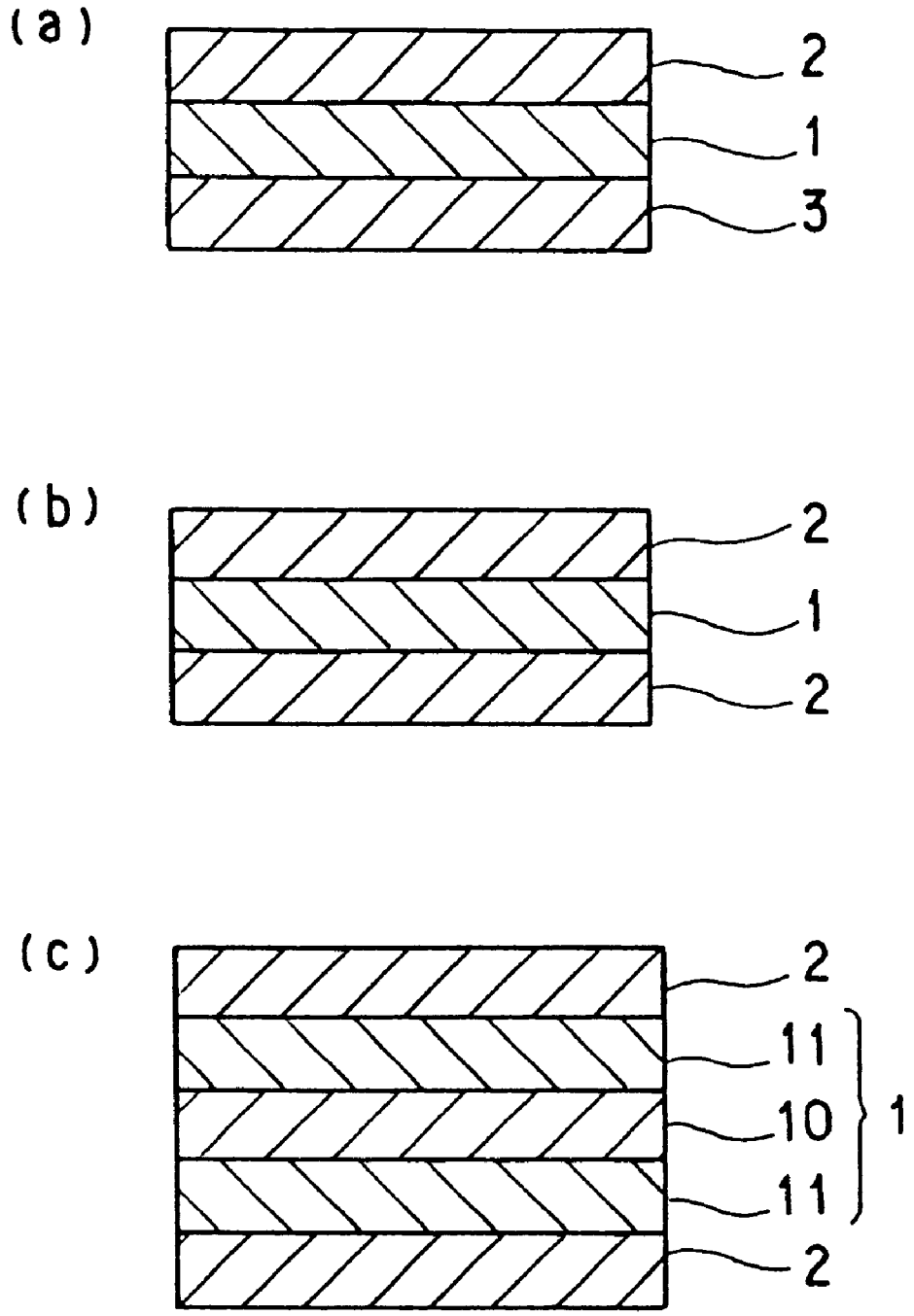
FIGS. 1(*a*), (*b*) and (*c*) represent the structures of the recording material of the present invention. The recording material of the present invention comprises a substrate 1 and an ink-receiving layer 2, and may comprise Japanese paper layers 11.

The substrate used for the present invention may consist of ordinary paper, tracing paper, coating paper, plastic films such as polyester films, cloth and the like and specific kind of those materials may be selected depending on the purposes of the recording material. When the recording material of the present invention is used as originals or used for OHP, substantially transparent substrates such as plastic films are used. Substrates comprising polyester films and Japanese paper sheets adhered on one side or both sides of the films may be preferably used instead of the tracing paper substrates. Those substrates show excellent anti-curling property and dimentional stability against moisture and heating during storage as well as excellent writing quality. Japanese paper sheets to be adhered to polyester films preferably have a basis weight of from 6 to 29 g/m$^2$. Adhesives of urea resins, phenolic resins, resorcinol resins, epoxy resins, urethane resins, polyester resins, acrylic resins and the like may be used for adhering Japanese paper sheets to the substrates.

The thickness of the substrate is not particularly limited and the substrate may have a thickness necessary for recording material, for example, a thickness of from 38 to 250 $\mu$m.

The ink-receiving layer is provided on one surface or both surfaces of the substrate and contains hydrophilic and lipophilic resins as resin components and, preferably, a matting agent.

Polyvinylpyrrolidone is used as the hydrophilic resin and a basic (meth)acrylic acid ester copolymer prepared from at least four kinds of monomers is used as the lipophilic resin. Since polyvinylpyrrolidone is a hydrophilic resin and generally insoluble or hardly soluble in an organic solvent used in oil inks for pen plotters and the like such as toluene, xylene, ketones and esters, the coating is not easily attacked even if such oil inks are used for recording and hence good recording is obtained. Further, polyvinylpyrrolidone is excellent in ink absorbency and color developing property with respect to aqueous inks such as those for ink-jet printing and, particularly when mixed with the (meth)acrylic acid ester copolymer described in detail hereinafter, it improves the properties necessary for the use in ink-jet printing such as ink adsorbing property, water resistance, weathering resistance and the like.

Polyvinylpyrrolidone used for the present invention may have a weight average molecular weight of not less than 100,000, preferably, of from 300,000 to 1,500,000. When the molecular weight is less than 100,000, the film-forming property is insufficient and hence it is difficult to form a coating. On the other hand, a molecular weight more than 1,500,000 is not preferred, since viscosity becomes too high with such a molecular weight and leveling property of the coating and the like are impaired.

The content of polyvinylpyrrolidone may vary depending on the composition of the component monomers of the (meth)acrylic acid ester copolymer which will be described in detail hereinafter, but it is generally not less than 10% by weight, preferably not less than 50% by weight of the total amount of the resin components and it is generally not more than 90% by weight, preferably not more than 80% by weight of the total amount of the resin components. By employing a polyvinylpyrrolidone content within such a range, both requirements of water resistance and water absorbency of the ink-receiving layer are satisfied.

The lipophilic resin, the basic (meth)acrylic acid ester copolymer is at least a tetracopolymer prepared from hydrophilic monomers comprising at least 2-hydroxyethyl (meth) acrylate (HEMA or HEA) and 2-dimethylaminoethyl methacrylate (DMMA) and water-resistant (lipophilic) monomers comprising at least methyl methacrylate (MMA) and n-butyl methacrylate (BMA). The copolymer may comprise five or more kinds of component monomer units so long as the individual properties of the copolymer are not deteriorated.

By using such a basic (meth)acrylic acid ester copolymer, the toner adhesion and the compatibility with polyvinylpyrrolidone are enhanced. Further, since the copolymer contains at least four kinds of monomer units and is prepared from at least two kinds of hydrophilic monomers and at least two kinds of water resistant monomers, it becomes easy to balance the hydrophilicity and the water resistance and, in addition, to adjust other properties such as physical properties of the coating by suitably selecting the ratio of the comonomers.

The molar ratio of the hydrophilic monomers and the water resistant (lipophilic) monomers may be about 1:1. Preferably, the amount of the hydrophilic monomers (DMMA and HEMA or HEA) is within a range of 30 to 70%, more preferably 40 to 60%, particularly 45 to 50% by mole based on the total amount of the monomers. If the amount of the hydrophilic monomers is too large, though the ink adsorbing property is enhanced when the copolymer is mixed with PVP, the coating becomes more likely to be solubilized and ink drying property is impaired even though the mixing ratio with PVP is adjusted. Further, the amount of the hydrophilic monomers exceeds 70% by mole, the toner adhesion in PPC is deteriorated. On the other hand, if the amount of the lipophilic monomers is too large, the compatibility with PVP is impaired and ink absorbing rate and drying rate are lowered.

The hydrophilic monomers to be copolymerized in the copolymer comprises at least DMMA and HEMA or HEA. Among the hydrophilic monomers, DMMA contains amino groups and hence makes the polymer basic and it can improve ink absorbency and ink adsorbing property. As a result of these improvements, weathering resistance, resolution and color developing property as well as adhesions with respect to PPC toner binders, ink of direct thermal transfer ribbons and the like are also improved. Further, by using DMMA, compatibility between the copolymer and PVP is also enhanced.

On the other hand, the hydrophilic monomer, HEMA or HEA improves water resistance without sacrificing hydrophilicity, and either of HEMA and HEA or both of them can be used for the copolymer.

The molar ratio of DMMA and HEMA or HEA may be in a range of from 3:1 to 1:3, preferably 2:1 to 1:2. By employing a molar ratio within such a range, toner or fused ink adhesion and adsorbing property with respect to aqueous inks are enhanced and a proper ink drying rate is ensured.

The lipophilic monomers to be copolymerized in the copolymer comprise at least MMA and BMA. Addition of MMA and BMA improves water resistance of the ink-receiving layer and ensures proper hardness of the coating. Therefore, by adding these lipophilic monomers, the recording material can have properties required for recording material for pen plotters such as scratch resistance. Among these lipophilic monomers, MMA and BMA can be used in a molar ratio of from 10:1 to 2:1, preferably 5:1 to 4:1. By using a molar ratio within such a range, blocking is prevented when they are mixed and an optimum hardness of the coating is ensured.

Further, so long as the properties of the copolymer are not impaired, other monomers such as ethyl (meth)acrylate (EMA) and 2-hydroxypropyl (meth)acrylate (HPMA) may be copolymerized in the copolymer.

Moreover, if necessary, second ink-receiving layer (not shown in the figures) which has a higher ink absorbency than that of the above-described ink-receiving layer (referred as the first ink-receiving layer hereinafter) may be provided between the substrate and the first ink-receiving layer. The second ink-receiving layer is provided in order to further absorb a large amount of the ink previously absorbed rapidly by the first ink-receiving layer to prevent overflow of the ink and to prevent decrease of ink absorbency of the first ink-receiving layer. This is because, if the ink absorbency of the first ink-receiving layer is insufficient, the ink absorbed by the first ink-receiving layer could not be further absorbed by deeper parts of the layer and thereby the drying of the ink may be delayed or the ink may unduly permeate or disperse in the layers with respect to the surface direction, which may result in that resolution of recorded images are lowered or it becomes impossible to form recorded images with good quality.

The second ink-receiving layer, which must satisfy the requirements described above, is preferably composed of a water-soluble or hydrophilic resin which is swelled with aqueous inks but not solubilized or swelled upon the formation of the first ink-receiving layer. Examples of the resin include natural resins such as albumin, gelatin, casein, starch, gum arabic and sodium alginate, and synthetic resins such as carboxymethyl cellulose, hydroxyethyl cellulose, polyamides, polyacrylamides, polyhydroxyethyl methacrylates, polyphenylacetoacetals, polyethyleneimines, polyvinylpyrrolidones, polyvinylpyridium halides, melamine resins, polyurethanes, polyvinyl alcohols, polyesters, sodium polyacrylate and acrylic acid copolymers, and they can be used alone or in any combination of two or more of them. Among these, polyvinyl alcohols are particularly preferred because of their absorbency and film-forming property. They may be used in combination with other resins to improve adhesion with the substrate and strength of the coating.

Higher saponification degree of polyvinyl alcohols which are suitably used for the second ink-receiving layer is more preferred to enhance ink absorbency, and those having a saponification degree of not less than 70%, preferably not less than 90% are used in order to prevent stickiness caused by moisture absorption and ensure necessary hydrophilicity.

Thickness of the first ink-receiving layer 2 may vary depending on amount of ink, kind of the resin used for the first ink-receiving layer 2 and the like, but its range is generally from 5 to 50 μm, preferably from 10 to 20 μm. A thickness of not less than 5 μm is preferred from the viewpoint of maintaining ink absorbency and a thickness of not more than 50 μm is preferred for preventing curling.

The recording material of the present invention is preferably matted to give writing quality. For this purpose, the substrate itself may be matted or a matting agent is added to the resin of the ink-receiving layer or both of these treatments may be employed. Matting may be carried out by any of known methods, for example, when the substrate is a plastic film, sand blast, chemical matting, addition of matting agents or the like may be employed.

The ink absorbency of the ink-receiving layer of the present invention is particularly improved by adding a matting agent. The matting agent may be selected from known matting agents such as silica (amorphous silica), clay, talc, diatomaceous earth, calcium carbonate, calcium sulfate, barium sulfate, aluminum silicate, titanium oxide, zinc oxide, synthetic zeolite and alumina and may be smectites. These matting agents may be used alone or in any combination thereof.

Among these matting agents, smectites is particularly preferred from the viewpoints of transparency and ink absorbency. Since smectites has a layered structure containing a number of exchangeable cations between the layers and, normally, two water molecular layers, it is very likely to adsorb water molecules and hence remarkably improve ink absorbency required for ink-jet recording. Furthermore, its large specific surface (about 600 $m^2/g$ in the case of hectorite) also contributes to improve the ink absorbency. In addition, since. smectites has a remarkably smaller particle diameter (about 10 angstroms in the layer thickness direction and that of micron order in the surface direction) as compared with known matting agents, it does not raise haze value and it makes possible to obtain a clear coating having a high transmisision density. Therefore, it is particularly preferred when the recording material of the present invention is used for OHP or used as second originals.

The matting agent may be used normally in an amount of 5 to 200 parts by weight with respect to 100 parts of the resin. The amount exceeding this range impairs binding ability of the resin and hence is not preferred.

The ink-receiving layer of the present invention may contain, in addition to the matting agents, various additives such as leveling agents, UV absorbing agents and antioxidants.

The recording material of the present invention may be prepared by coating the resin, the matting agent and other additives described above, which will constitute the ink-receiving layer, dissolved or dispersed in a suitable solvent onto one or both surfaces of the substrate and drying it. The solvent may be, for example, propylene glycol monomethyl ether, methylene glycol monomethyl ether, ethyl alcohol, methyl alcohol, iso-propyl alcohol or the like. The thickness of the ink-receiving layer is not particularly limited, but it normally has a thickness of from 0.1 to 50 μm, preferably of from 1 to 20 μm. If the thickness exceeds 50 μm, ink is absorbed by only the surface of the recording layer and hence sufficient optical density (of ink) cannot be obtained.

FIGS. 1(*a*), (*b*) and (*c*) illustrate structures of the recording material of the present invention. FIG. 1(*a*) represents the one where the ink-receiving layer 2 is provided on one side of the substrate 1, and FIGS. 1(*b*) and (*c*) represent the ones where the ink-receiving layers 2 are provided on both sides of the substrate 1. If the ink-receiving layer 2 is provided on one side of the substrate 1, a back-coat layer 3 may be provided on the surface opposite to the surface provided with the ink-receiving layer in order to prevent curling or charging or to improve transferability of the paper. The back-coat layer 3 may also have traceability and such a back-coat layer 3 may be composed of polyurethane resins, cellulose resins, acrylic resins, water-soluble resins and the like.

Further, when a plastic film is used for the substrate 1, a primer layer (not shown) is preferably provided on the surface of the film to be provided with the ink-receiving layer in order to enhance the adhesion of the film with the ink-receiving layer 2 (and the back-coat layer 3). The plastic film may be treated so that it can be easily adhered. As a material of the primer layer, there can be mentioned polyester resins, polyvinylidene chloride, polyacrylonitrile, acrylic resins and the like.

When a plastic film 10 such as a polyester film adhered with Japanese paper or tracing paper sheets 11 is used as the substrate 1, the ink-receiving layers 2 can be provided directly on the Japanese paper or tracing paper sheets without the primer layers (FIG. 1(*c*)).

The recording material of the present invention having a structure such as described above can show excellent fixing properties with respect to inks or toners for printing means of various printing method such as direct thermal transfer printing and PPC as well as ink-jet printing, show also excellent absorbency and fixing properties with respect to aqueous and oil inks for recording means such as plotters, give water resistance and proper hardness of the coating and show also excellent ink absorbency, drying property and color developing property with respect to ink-jet printing. Therefore, the recording material of the present invention can be used for all of these printing methods in common.

EXAMPLES

The present invention is further illustrated by referring the following examples.

In the following Examples 1 to 3 and Comparative Example 1, a copolymer prepared by copolymerizing 45% by mole of MMA, 10% by mole of BMA, 30% by mole of HEMA and 15% by mole of DMMA was used as the (meth)acrylic acid ester copolymer.

Example 1

On surfaces of substrates composed of polyester films (LUMIRROR S-14, Toray Inc.), ink-receiving layer coating solution having the following composition was coated by means of a bar coater and dried so that the resulting ink-receiving layers had a thickness of 8 μm in dry state to give recording sheets.

| | |
|---|---|
| PVP (K-90, ISP Co., Ltd.) | 3 parts by weight |
| (Meth) acrylic acid ester copolymer | 2 parts by weight |
| Methyl cellosolve | 45 parts by weight |

Properties of the obtained recording sheets such as ink-receiving property were evaluated by using the sheets in printing by a ink-jet printer (DESKJET 500J, Hewlett Packard Co.), PPC machine (RICOPY FT-5500, RICOH Co., Ltd.), direct thermal transfer printing machine (OASYS 30LXII, Fujitsu Ltd.) or color plotter (FPG-300, Fujitsu Ltd.). As a result, good ink drying rate in ink-jet printing was observed, and practically acceptable printed letters were obtained from the viewpoints of adhesions of PPC toners and fused ink. Further, good printed letters were obtained also in printing by the color plotter.

Comparative Example 1

On surfaces of substrates composed of polyester films (LUMIRROR S-14, Toray Inc.), ink-receiving layer coating solution having the following composition was coated by means of a bar coater and dried so that the resulting ink-receiving layers had a thickness of 8 μm in dry state to give recording sheets. Properties of the obtained recording sheets such as ink-receiving property were evaluated in the same manner as in Example 1.

| | |
|---|---|
| PVP (K-90, ISP Co., Ltd.) | 3 parts by weight |
| Styrene-acrylic acid ester copolymer | 2 parts by weight |
| Methyl cellosolve | 45 parts by weight |

As a result, ink drying rate in ink-jet printing was lower than that of Example 1 and adhesions of toners and fused ink were inferior to those of Example 1.

Comparative Example 2

On surfaces of substrates composed of polyester films (LUMIRROR S-14, Toray Inc.), ink-receiving layer coating solution having the following composition was coated by means of a bar coater and dried so that the resulting ink-receiving layers had a thickness of 8 μm in dry state to give recording sheets. Properties of the obtained recording sheets such as ink-receiving property were evaluated in the same manner as in Example 1.

| | |
|---|---|
| PVP (K-90, ISP Co., Ltd.) | 3 parts by weight |
| MMA polymer (PARALOIDE A-11, Rohm & Haas Co.) | 2 parts by weight |
| Methyl cellosolve | 45 parts by weight |

As a result, ink drying rate in ink-jet printing was lower than that of Example 1 and adhesions of toners and fused ink were inferior to those of Example 1.

Comparative Example 3

On surfaces of substrates composed of polyester films (LUMIRROR S-14, Toray Inc.), ink-receiving layer coating solution having the following composition was coated by means of a bar coater and dried so that the resulting ink-receiving layers had a thickness of 8 μm in dry state to give recording sheets. Properties of the obtained recording sheets such as ink-receiving property were evaluated in the same manner as in Example 1.

| | |
|---|---|
| (Meth) acrylic acid ester copolymer | 5 parts by weight |
| Methyl cellosolve | 45 parts by weight |

As a result, ink drying rate in ink-jet printing was extremely low and most of the ink was not absorbed.

Example 2

On surfaces of substrates composed of polyester films (LUMIRROR S-14, Toray Inc.), ink-receiving layer coating solution having the following composition was coated by means of a bar coater and dried so that the resulting ink-receiving layers had a thickness of 8 μm in dry state to give recording sheets.

| | |
|---|---|
| PVP (K-90, ISP Co., Ltd.) | 3 parts by weight |
| (Meth) acrylic acid ester copolymer | 2 parts by weight |
| Amorphous silica (MIZUKASIL P78A, Mizusawa Chemical Co., Ltd.) | 4 parts by weight |
| Methyl cellosolve | 81 parts by weight |

Properties of the obtained recording sheets such as ink-receiving property were evaluated by using the sheets in printing by a ink-jet printer (DESKJET 500J, Hewlett Packard Co.), PPC machine (RICOPY FT-5500, RICOH Co., Ltd.), direct thermal transfer printing machine (OASYS 30LXII, Fujitsu Ltd.) or color plotter (FPG-300, Fujitsu Ltd.). As a result, in ink-jet printing, high ink drying rate and no blocking were observed. Further, good adhesions of PPC toners and fused ink were also observed and printed characters of good quality with respect to fine line and color reproducibilities were obtained in plotting by the color plotter.

Example 3

On surfaces of substrates composed of polyester films (LUMIRROR S-14, Toray Inc.), ink-receiving layer coating solution having the following composition was coated by means of a bar coater and dried so that the resulting ink-receiving layers had a thickness of 8 μm in dry state to give recording sheets with excellent transparency of the coatings.

| | |
|---|---|
| PVP (K-90, ISP Co., Ltd.) | 3 parts by weight |
| (Meth) acrylic acid ester copolymer | 2 parts by weight |
| Synthetic smectites (SWN, Co-op Chemical Co., Ltd) | 4 parts by weight |
| Methyl cellosolve | 81 parts by weight |

Properties of the obtained recording sheets such as ink-receiving property were evaluated by using the sheets in printing by a ink-jet printer (DESKJET 500J, Hewlett Packard Co.), PPC machine (RICOPY FT-5500, RICOH Co., Ltd.), direct thermal transfer printing machine (OASYS 30LXII, Fusitsu Co.,Ltd.) or color plotter (FPG-300, Fujitsu Ltd.). As a result, in ink-jet printing, very high ink drying rate and no blocking were observed. Further, good adhesions of PPC toners and fused ink were also observed and printed characters of good quality with respect to fine line and color reproducibilities were obtained in plotting by the color plotter.

Comparative Example 4

On surfaces of substrates composed of polyester films (LUMIRROR S-14, Toray Inc.), ink-receiving layer coating solution having the following composition was coated by means of a bar coater and dried so that the resulting ink-receiving layers had a thickness of 8 μm in dry state to give recording sheets. Properties of the obtained recording sheets such as ink-receiving property were evaluated in the same manner as in Example 1.

| | |
|---|---|
| PVP (K-90, ISP Co., Ltd.) | 3 parts by weight |
| Styrene-acrylic acid copolymer (JOHNCRYL 586, Johnson Polymer Co., Ltd) | 2 parts by weight |
| Amorphous silica (MIZUKASIL P78A, Mizusawa Chemical Co., Ltd.) | 4 parts by weight |
| Methyl cellosolve | 81 parts by weight |

As a result, though ink drying rate in ink-jet printing was relatively high, adhesions of PPC toners and fused ink were extremely bad.

Example 4

On surfaces of substrates composed of polyester films (LUMIRROR S-14, Toray Inc.), ink-receiving layer coating solution having the following composition was coated by means of a bar coater and dried so that the resulting ink-receiving layers had a thickness of 8 $\mu$m in dry state to give recording sheets. Properties of the obtained recording sheets such as ink-receiving property were evaluated in the same manner as in Example 1. The (Meth)acrylic acid ester copolymer used in this example was prepared by copolymerizing 42% by mole of MMA, 8% by mole of BMA, 25% by mole of HEMA, 15% by mole of DMMA, 5% by mole of EMA and 5% by mole of HPMA.

| | |
|---|---|
| PVP (K-90, ISP Co., Ltd.) | 3 parts by weight |
| (Meth) acrylic acid ester copolymer | 2 parts by weight |
| Methyl cellosolve | 45 parts by weight |

As a result, like Example 1, good ink drying rate in ink-jet printing was observed, and printed letters practically acceptable from the viewpoints of adhesions of PPC toners and fused ink were obtained. Further, good printed letters were obtained also in printing by the color plotter.

As seen from the results of the above examples, according to the present invention, recording material showing excellent absorbency for ink-jet printing ink and drying property as well as water resistance and weathering resistance can be obtained by using the combination of polyvinylpyrrolidone and a basic (meth)acrylic acid ester copolymer prepared from specific monomers for the resin of the ink-receiving layer. Moreover, the ink absorbency of the ink-receiving layer can be remarkably increased by adding a matting agent to the resins. Further, recording material having good adhesions with respect to PPC toner and fused ink and properties required for printing by pen plotters such as scratch resistance, in addition to the properties required for ink-jet printing, can be provided according to the present invention. In addition, by using a specific matting agent, there is provided recording material which has light transmitting property and hence may be used as originals according to the present invention.

What is claimed is:

1. A recording material comprising a substrate and at least one ink-receiving layer provided on at least one surface of the substrate, said ink-receiving layer comprising 10–90 wt. % of polyvinylpyrrolidone having a weight average molecular weight of at least 100,000 and a basic (meth)acrylic acid ester copolymer of at least two different hydrophilic monomers and at least two different lipophilic monomers, said hydrophilic monomers being 30–70 mole % of the total of lipophilic monomers and said hydrophilic monomers.

2. The recording material of claim 1 wherein said hydrophilic monomers comprise 2-hydroxyethyl (meth)acrylate and 2-dimethylaminoethyl methacrylate and said lipophilic monomers comprise methyl methacrylate and n-butyl methacrylate.

3. The recording material of claim 1 wherein said substrate comprises a polyester film.

4. The recording material of claim 3 wherein said substrate comprises a matting agent.

5. The recording material of claim 1 wherein said substrate comprises a matting agent.

6. The recording material of claim 1 wherein said ink-receiving layer comprises 50–80 wt. % polyvinylpyrrolidone.

7. The recording material of claim 6 wherein said hydrophilic monomers are 45–50 mole % of the total of said lipophilic and said hydrophilic monomers.

8. The recording material of claim 1 wherein said hydrophilic monomers are 45–50 mole % of the total of said lipophilic and said hydrophilic monomers.

* * * * *